US010695785B2

(12) United States Patent
Guo et al.

(10) Patent No.: US 10,695,785 B2
(45) Date of Patent: Jun. 30, 2020

(54) SOUND PRODUCING MEMBER ADAPTED TO PRESS AT ANY ANGLE, PRESS-SWITCHING WATER DISCHARGING MECHANISM AND SHOWER HEAD

(71) Applicant: Xiamen Suitec Sanitary Wares & Fittings Co., Ltd., Xiamen (CN)

(72) Inventors: Jianhua Guo, Xiamen (CN); Yongkuan Wang, Xiamen (CN)

(73) Assignee: Xiamen Suitee Sanitary Wares & Fittings Co., Ltd., Xiamen (CN)

( * ) Notice: Subject to any disclaimer, the term of this patent is extended or adjusted under 35 U.S.C. 154(b) by 81 days.

(21) Appl. No.: 16/155,853

(22) Filed: Oct. 9, 2018

(65) Prior Publication Data

US 2019/0143359 A1 May 16, 2019

(30) Foreign Application Priority Data

Nov. 14, 2017 (CN) ..... 2017 2 1518029 U

(51) Int. Cl.

| | |
|---|---|
| ***B05B 15/00*** | (2018.01) |
| ***B05B 1/18*** | (2006.01) |
| ***B05B 1/16*** | (2006.01) |
| ***G10K 15/04*** | (2006.01) |

(52) U.S. Cl.

CPC ..... *B05B 15/00* (2013.01); *B05B 1/1636* (2013.01); *B05B 1/18* (2013.01); *G10K 15/04* (2013.01)

(58) Field of Classification Search

CPC ..... B05B 1/18; B05B 1/1636; B05B 15/00; G10K 15/04; H04R 1/028

USPC ..... 239/72, 289; 4/559, 567, 597, 615, 661

See application file for complete search history.

(56) References Cited

U.S. PATENT DOCUMENTS

| | | | | |
|---|---|---|---|---|
| 3,557,899 | A * | 1/1971 | Longinette | B06B 1/0276 601/2 |
| 3,720,908 | A * | 3/1973 | McCoy | G10K 15/04 367/148 |
| 5,140,254 | A * | 8/1992 | Katzman | A47K 3/281 290/54 |
| 5,647,007 | A * | 7/1997 | Wooderson | A45D 20/42 381/332 |
| 6,061,457 | A * | 5/2000 | Stockhamer | H04R 1/00 367/140 |
| 6,892,952 | B2 * | 5/2005 | Chang | E03C 1/0409 236/12.12 |
| 9,776,196 | B2 * | 10/2017 | Yu | A47K 3/28 |
| 10,003,873 | B2 * | 6/2018 | Hanna | H04R 1/028 |
| 10,456,793 | B2 * | 10/2019 | Nikles | F03B 13/10 |

(Continued)

*Primary Examiner* — Alex M Valvis

(57) ABSTRACT

The present disclosure discloses a sound producing member adapted to press at any angle and a press-switching water discharging mechanism and a shower head. The sound producing member is a rotating shaft having a semicircular cross section, and the rotating shaft includes an abutment surface for abutting a press-switching water discharging valve and an arc-shaped surface adapted to press at any angle; pivot shafts for being rotatably installed at the bottom of a button are disposed at two ends of the rotating shaft, the arc-shaped surface is adapted with a contact surface at the bottom of the button; and a sound producing member adapted with a contact surface of the press-switching water discharging valve is concave in shape and is disposed in the abutment surface of the sound producing member.

7 Claims, 5 Drawing Sheets

(56) References Cited

U.S. PATENT DOCUMENTS

| | | | | |
|---|---|---|---|---|
| 2013/0092752 | A1* | 4/2013 | Schumacher | B05B 1/3013 239/154 |
| 2016/0236212 | A1* | 8/2016 | Patton | B05B 1/185 |

* cited by examiner

SOUND PRODUCING MEMBER ADAPTED TO PRESS AT ANY ANGLE, PRESS-SWITCHING WATER DISCHARGING MECHANISM AND SHOWER HEAD

CROSS-REFERENCE TO RELATED APPLICATIONS

The present application claims the benefit of Chinese Patent Application No. 201721518029.4, filed on Nov. 14, 2017, the entire content of which is hereby incorporated by reference.

TECHNICAL FIELD

The present disclosure relates to a bathroom accessory technology, and particularly to a sound producing member adapted to be pressed at any angle, a press-switching water discharging mechanism including the sound producing member, and a shower head including the press-switching water discharging mechanism.

BACKGROUND

At present, a shower head refers to a shower nozzle for showering. In modern society, people often take a shower after work to eliminate the fatigue of the day. A single-functional shower head may not meet the needs of consumers. A multifunctional shower head, that is, one shower head usually has multiple water discharging manners.

In order to adjust the water discharging manners of the shower head, the shower head commonly has a button thereon. The button is pressed to drive a press-switching water discharging mechanism to selectively or partially block water distributing holes corresponding to an upper water distributing base, so as to communicate water distributing channels with different functions, so that the water discharging manners of the shower head are adjusted. However, no sound is emitted in a press-switching process, and there is no prompt signal about whether the shower head is switched or not, so that the switching experience of a user is reduced.

SUMMARY

An aspect of the present disclosure isa sound producing member adapted to be pressed at any angle. The shape of the sound producing member can be formed into a rotating shaft from an original sheet, and in addition, an original fixation manner by sweat soldering can be changed to a rotatably installation manner. That is, pivot shafts of the sound producing member can be rotatably installed in a button, even if the pressing is implemented from a peripheral edge of the button or a pressing angle is applied, since the sound producing member rotates to adapt to a pressing stress in any angular direction. A sound emitting groove can have a shape adapted with a contact surface of a press-switching water discharging valve, a sound emitting area of pressing or resilience is increased, surface contact drive connection between the press-switching water discharging mechanism and the button is perfectly realized, and the phenomena such as jamming and lack of smoothness when the button is pressed are avoided.

Another aspect of the present disclosure is a press-switching water discharging mechanism including the sound producing member. In this embodiment, pivot shafts of the sound producing member are rotatably installed in installation slots of limit bases by providing the sound producing member and the limit bases at the bottom of the button. Even if pressing is implemented from a peripheral edge of the button or a pressing angle is applied, an arc-shaped surface of the sound producing member is adapted with arc-shaped surfaces of the installation slots. A pressing stress in any angular direction may be adapted during rotation, surface contact drive connection between the press-switching water discharging mechanism and the button is perfectly realized, the pressing drive stability is improved, and the phenomena such as jamming and lack of smoothness when the button is pressed are avoided.

Another aspect of the present disclosure is a shower head including the press-switching water discharging mechanism. The press-switching water discharging mechanism of the shower head is reasonable in structure, few in components, compact in structures of the components, and small in occupied space inside the shower head, to enable the shower head to be made thinner, and enable the button and a surface cover to be integrally formed, so as to reduce the button as the component, simplify the production procedure and reduce the production cost. Moreover, a design of reducing the button may prevent pollutants from entering the shower head from a gap between the button and the outer wall of the shower head, thereby affecting the health of the person.

In another aspect of the present disclosure, a sound producing member adapted to press at any angle is a rotating shaft having a semicircular cross section, and the rotating shaft includes an abutment surface for abutting a press-switching water discharging valve and an arc-shaped surface adapted to press at any angle. The pivot shafts for being rotatably installed at the bottom of a button are disposed at two ends of the rotating shaft, and the arc-shaped surface is adapted with a contact surface at the bottom of the button. A sound emitting groove adapted with the contact surface of the press-switching water discharging valve is concave in shape and disposed on the abutment surface of the sound producing member.

The sound producing member can be provided with limit ribs for preventing the rotating shaft from rotating 360°, and the limit ribs can be located at two sides of the sound emitting groove.

In another aspect of the present disclosure, a press-switching water discharging mechanism adapted to press at any angle includes a press-switching water discharging valve for switching water channels with different functions, a button disposed above the press-switching water discharging valve, and the sound producing member disposed between the press-switching water discharging valve and the button and adapted to press at any angle. A switching shaft is disposed on the press-switching water discharging valve, the sound producing member is adapted with the top of the switching shaft, and limit bases for installing pivot shafts are disposed at the bottom of the button. Installation slots are concave in shape and are disposed on the limit bases, and the pivot shafts are rotatably installed in the installation slots of the limit bases.

Guiding inclined surfaces for rapidly installing the pivot shafts can be disposed on the limit bases, and located above the installation slots.

A plurality of slots are arranged around a top part of the switching shaft; a plurality of tongues, which are capable of fitting within the slots, are provided around an inner wall of the sound emitting groove, so that the switching shaft and the sound emitting groove are held together.

The press-switching water discharging valve further includes an upper water distributing base, a lower water distributing base, a positioning shaft and a spring; a positioning slot is positioned in the center of the switching shaft, a water distributing tray is vertically connected to the bottom of the switching shaft, and the switching shaft and the water distributing tray are integrally formed; at least two water outlets are opened on the water distributing tray; upper wedge-shaped teeth and lower wedge-shaped teeth are disposed at an upper surface and a lower surface of the water distributing tray; the positioning slot runs through the water distributing tray; the upper water distributing base is provided with a first shaft hole, at least two water distributing holes and at least two water distributing channels corresponding to the water distributing holes; the water distributing holes are communicated with the corresponding water distributing channels; first wedge-shaped teeth matched with the upper wedge-shaped teeth are disposed on the first shaft hole; the lower water distributing base is provided with a second shaft hole, second wedge-shaped teeth matched with the lower wedge-shaped teeth are disposed on the second shaft hole; the upper water distributing base is sealed and fixedly connected with the lower water distributing base, and a water distributing chamber is formed between the upper water distributing base and the lower water distributing base, the water distributing tray and the switching shaft are installed in the water distributing chamber; the positioning shaft is inserted into the positioning slot of the switching shaft; the spring is sleeved on the outer wall of the positioning shaft, one end of the spring abuts against the positioning slot, and the other end thereof abuts against the head of the positioning shaft; and the top of the switching shaft extends out from the first shaft hole of the upper water distributing base and can telescopically abut against the sound emitting groove of the sound producing member; and by pressing the switching shaft, the lower wedge-shaped teeth of the switching shaft are matched with the second wedge-shaped teeth of the lower water distributing base, so as to drive the water distributing tray to selectively or partially block the water distributing holes corresponding to the upper water distributing base, so that the water distributing channels with different functions are communicated.

A tenon can be disposed on the inner wall of the positioning slot of the water distributing tray, and the spring abuts against the tenon of the water distributing tray.

The upper water distributing base can be fixedly connected with the lower water distributing base by a fastener, and a first O-shaped sealing ring can be disposed on a contact surface between the upper water distributing base and the lower water distributing base.

A contour sealing ring can be disposed between the upper water distributing base and the water distributing tray, and the upper water distributing base can be internally provided with an accommodating slotted hole matched with the contour sealing ring, and the contour sealing ring can be installed in the accommodating slotted hole.

In another aspect of the present disclosure, a shower head includes a shower head body, a water discharging body, a surface cover and a press-switching water discharging mechanism adapted to press at any angle, and at least two functional water channels disposed on the water discharging body, each functional water channel is in communication with the corresponding water distributing channel; the surface cover is engaged with the shower head body to form an accommodating chamber, and the water distributing body and the press-switching water discharging mechanism are prevented from being in the accommodating chamber; the press-switching water discharging mechanism includes a press-switching water discharging valve for switching different functional water channels, a button disposed above the press-switching water discharging valve and a sound producing member disposed between the press-switching water discharging valve and the button;

the button and the surface cover are integrally connected, and injection-molded at one time; the limit bases of the button are disposed at the bottom of the surface cover; the sound producing member is a rotating shaft having a semicircular cross section, and the rotating shaft includes an abutment surface for abutting the press-switching water discharging valve and an arc-shaped surface adapted to press at any angle; pivot shafts for being rotatably installed at the bottom of the button are disposed at two ends of the rotating shaft, and the arc-shaped surface is matched with a contact surface at the bottom of the button; and a sound emitting groove matched with the contact surface of the press-switching water discharging valve is concave in shape and is disposed on the contact surface of the sound producing member;

the press-switching water discharging valve includes a switching shaft, an upper water distributing base, a lower water distributing base, a positioning shaft and a spring, wherein the sound emitting groove is adapted with the top of the switching shaft; limit bases for installing pivot shafts are disposed at the bottom of the surface cover, installation slots are concave in shape and are disposed on the limit bases, the pivot shafts are rotatably installed in the installation slots of the limit bases; a positioning slot is disposed in the center of the switching shaft, a water distributing tray is vertically connected to the bottom of the switching shaft, the switching shaft and the water distributing tray are integrally formed; at least two water outlets are opened on the water distributing tray; upper wedge-shaped teeth and lower wedge-shaped teeth are disposed at an upper surface and a lower surface of the water distributing tray; the positioning slot runs through the water distributing tray; the upper water distributing base is provided with a first shaft hole, at least two water distributing holes and at least two water distributing channels corresponding to the water distributing holes; the water distributing holes are communicated with the corresponding water distributing channels; first wedge-shaped teeth matched with the upper wedge-shaped teeth are disposed on the first shaft hole; the lower water distributing base is provided with a second shaft hole, second wedge-shaped teeth matched with the lower wedge-shaped teeth are disposed on the second shaft hole; the upper water distributing base is sealed and fixedly connected with the lower water distributing base, and a water distributing chamber is formed between the upper water distributing base and the lower water distributing base, the water distributing tray and the switching shaft are installed in the water distributing chamber; the positioning shaft is inserted into the positioning slot of the switching shaft; the spring is sleeved on the outer wall of the positioning shaft, one end of the spring abuts against the positioning slot, and the other end thereof abuts against the head of the positioning shaft; and the top of the switching shaft extends out from the first shaft hole of the upper water distributing base and can telescopically abut against the sound emitting groove of the sound producing member; and by pressing the switching shaft, the lower wedge-shaped teeth of the switching shaft are matched with the second wedge-shaped teeth of the lower water distributing base, so as to drive the water distributing tray to selectively or partially block the water distributing holes corresponding to the upper water distributing base, so that the water distributing channels with different functions are communicated.

The sound producing member can be formed into a rotating shaft from an original sheet, and an original fixation manner by sweat soldering can be changed to a rotatable installation manner, that is, pivot shafts of the sound producing member can be rotatably installed in a button, even if pressing is implemented from a peripheral edge of the button or a pressing angle is applied, since the sound producing member rotates to adapt to a pressing stress in any angular direction, and a sound emitting groove having a shape adapted with a contact surface of a press-switching water discharging valve, a sound emitting area of pressing or resilience is increased, surface contact drive connection between the press-switching water discharging mechanism and the button is perfectly realized, and the phenomena such as jamming and lack of smoothness when the button is pressed are avoided.

In the figures: 100, press-switching water discharging mechanism; 1, press-switching water discharging valve; 11, switching shaft; 111, slot; 112, positioning slot; 12, water distributing tray; 121, water discharging hole; 122, upper wedge-shaped tooth; 123, lower wedge-shaped tooth; 124, tenon; 13, upper water distributing base; 131, first shaft hole; 132, water distributing hole; 133, water distributing channel; 134, first wedge-shaped tooth; 14, lower water distributing base; 141, second shaft hole; 142, second wedge-shaped tooth; 15, positioning shaft; 16, spring; 17, fastener; 18, first O-shaped sealing ring; 19, contour sealing ring; 2, sound producing member; 21, sound emitting groove; 22, pivot shaft; 23, limit rib; 24, abutment surface; 25, arc-shaped surface; 26, tongue; 3, button; 31, limit base; 311, installation slot; 312, guiding inclined surface; 200, shower head body; 300, water discharging body; and 400, surface cover.

DETAILED DESCRIPTION

The present disclosure will be further described below in conjunction with accompanying drawings and specific embodiments. It should be noted that the embodiments described below or technical features may be arbitrarily combined to form new embodiments without any conflicts.

Embodiment 1. A Sound Producing Member Adapted to Press at any Angle

Figure 1:
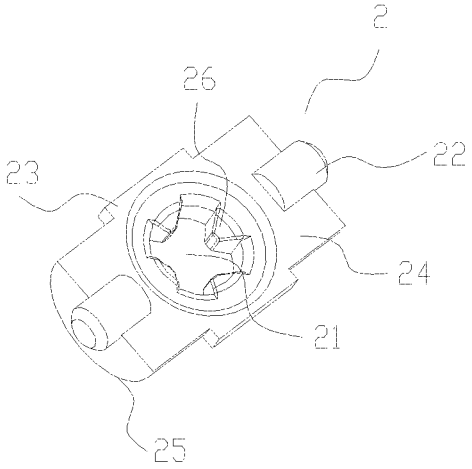
FIG. 1 is a schematic diagram showing a structure of a sound producing member according to an embodiment of the present disclosure.

As shown in FIG. 1, the sound producing member 2 is a rotating shaft having a semicircular cross section, and the rotating shaft includes an abutment surface 24 for abutting a press-switching water discharging valve and an arc-shaped surface 25 adapted to press at any angle; pivot shafts 22 for being rotatably installed on the bottom of the button are disposed at two ends of the rotating shaft, and the arc-shaped surface is adapted with a contact surface at the bottom of the button; and a sound emitting groove 21 adapted with the contact surface of the press-switching water discharging valve is concave in shape and is disposed on the abutment surface of the sound producing member.

Preferably, the sound producing member is provided with limit ribs 23 for preventing the rotating shaft from rotating 360°, and there are two limit ribs, which are respectively located at two sides of the sound emitting groove. The limit ribs are designed to limit a rotation angle of the sound producing member, and prevent the 360° rotation of the sound producing member from causing a force transmission failure, thereby affecting the drive of the button.

In this embodiment, the sound producing member is changed into a rotating shaft from an sheet in the prior art, and in addition, an original fixation manner of sweat soldering is changed to a rotatable installation manner, that is, pivot shafts of the sound producing member are rotatably installed in the button, even if pressing is implemented from a peripheral edge of the button or a pressing angle is applied, since the sound producing member rotates to adapt to a pressing stress in any angular direction, and the a sound emitting groove is adapted with the contact surface of a press-switching water discharging valve, a sound emitting area of pressing or resilience is increased, surface contact drive connection between the press-switching water discharging mechanism and the button is perfectly realized, and the phenomena such as jamming when the button is pressed are avoided.

Embodiment 2. A Press-Switching Water Discharging Mechanism Adapted to Press at any Angle As shown in FIG. 2 to FIG. 7, the press-switching water discharging mechanism 100 adapted to press at any angle includes a press-switching water discharging valve 1 for switching different functional water channels, a button 3 disposed above the press-switching water discharging valve, and the sound producing member 2 disposed between the press-switching water discharging valve and the button and adapted to press at any angle; and a switching shaft 11 is disposed on the press-switching water discharging valve, the sound emitting groove is adapted with the top of the switching shaft; and limit bases 31 for installing pivot shafts are disposed at the bottom of the button, installation slots 311 are concave in shape and are disposed on the limit bases, and the pivot shafts are rotatably installed in the installation slots of the limit bases.

In this embodiment, the pivot shafts of the sound producing member are rotatably installed in the installation slots of the limit bases by providing the sound producing member and the limit bases at the bottom of the button, even if pressing is implemented from a peripheral edge of the button or a pressing angle is applied, since a pressing stress in any angular direction may be adapted during rotation of the sound producing member, drive connection between the top of the switching shaft and the button is perfectly realized, and the phenomena such as jamming and un-smoothness when the button is pressed are avoided.

Preferably, guiding inclined surfaces 312 for rapidly installing the pivot shafts are disposed on the limit bases, and located above the installation slots. A design of the guiding inclined surfaces enables the pivot shafts of the sound producing member to be rapidly installed in the installation slots of the limit bases, is simple in operation, and realizes rapid installation.

In order to be further suitable for stress propagation of the button, a plurality of slots 111 may be arranged around a top part of the switching shaft 11. A plurality of tongues 26, which are capable of fitting within the slots 111, are provided around the inner wall of the sound emitting groove 21, so that the swift shaft 11 and the sound emitting groove 21 are held together.

Figure 2:
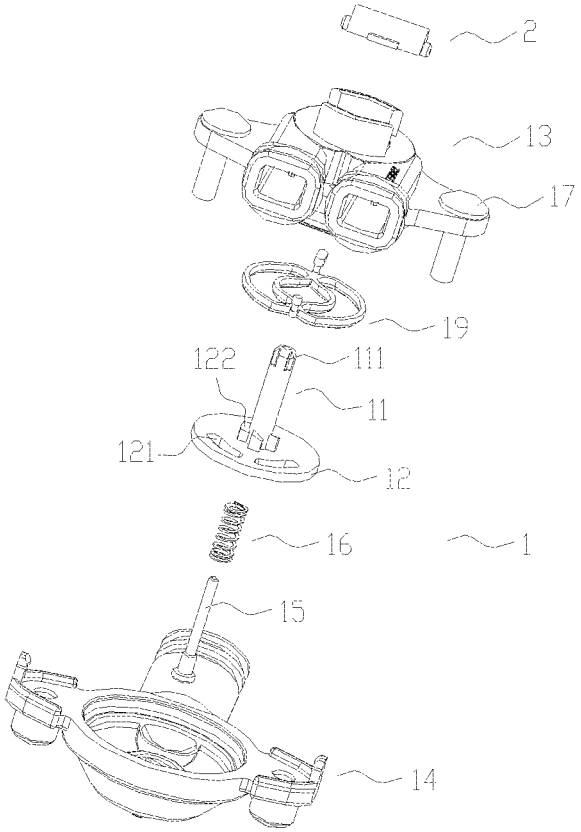
FIG. 2 is a schematic diagram showing a structure of a press-switching water discharging mechanism according to an embodiment of the present disclosure.
Figure 3:
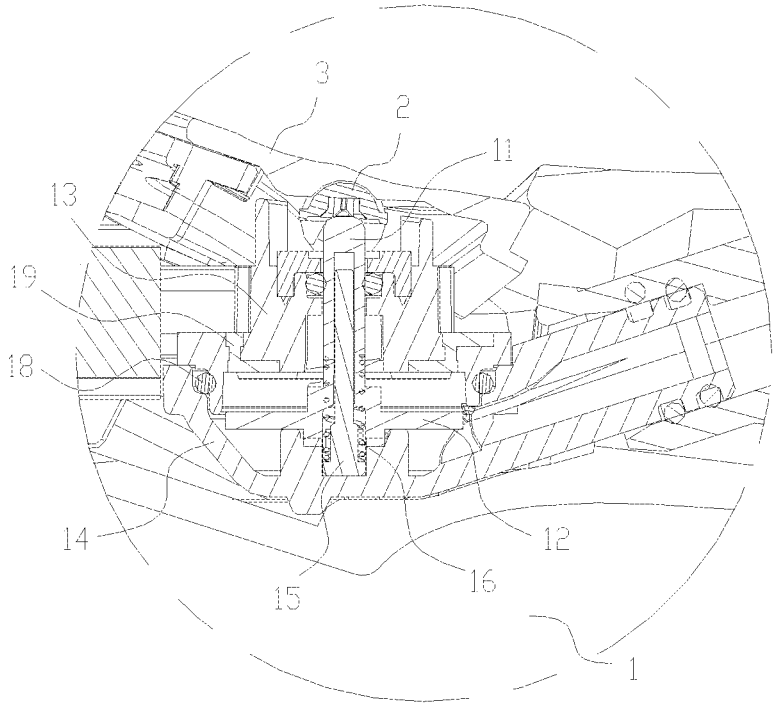
FIG. 3 is a cross-sectional view of a press-switching water discharge mechanism.
Figure 4:
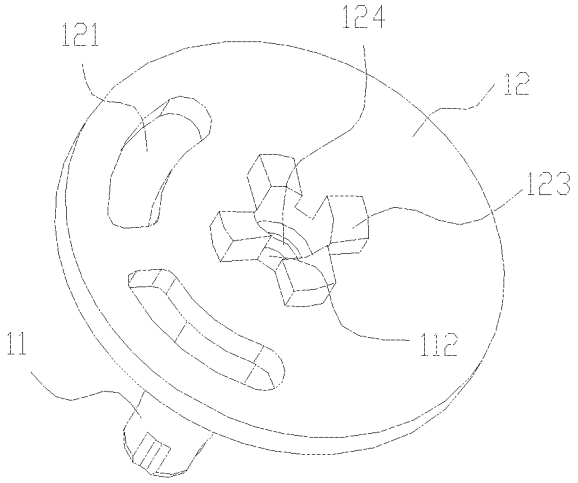
FIG. 4 is a schematic diagram showing a structure of a water distributing tray.

Particularly, the press-switching water discharging valve further includes an upper water distributing base 13, a lower water distributing base 14, a positioning shaft 15 and a spring 16; and wherein as shown in FIG. 2 and FIG. 4, a positioning slot 112 is positioned in the center of the switching shaft, a water distributing tray 12 is vertically connected to the bottom of the switching shaft, and the switching shaft and the water distributing tray are integrally formed; at least two water outlets 121 are opened on the water distributing tray; upper wedge-shaped teeth 122 and lower wedge-shaped teeth 123 are disposed at an upper surface and a lower surface of the water distributing tray; the positioning slot runs through the water distributing tray; and preferably, there are two water outlets on the water distributing tray in this embodiment.

Figure 5:
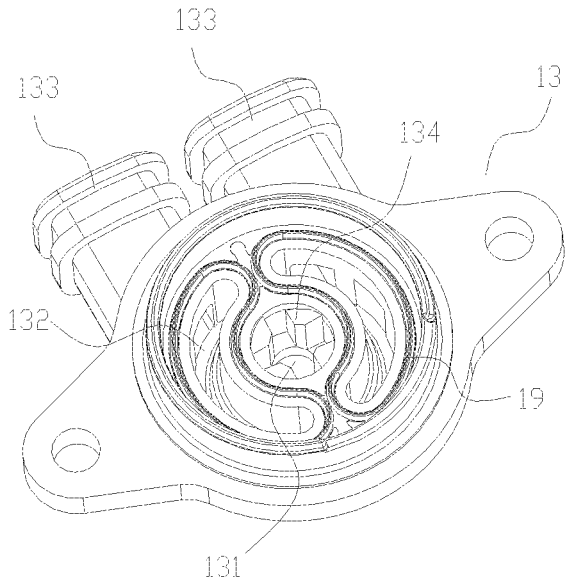
FIG. 5 is a schematic diagram showing a structure of an upper water distributing base.

As shown in FIG. 5, the upper water distributing base is provided with a first shaft hole 131, at least two water distributing holes 132 and at least two water distributing channels 133 corresponding to the water distributing holes; the water distributing holes are communicated with the corresponding water distributing channels; first wedge-shaped teeth 13 matched with the upper wedge-shaped teeth are disposed on the first shaft hole; and preferably, there are two water distributing holes and two water distributing channels in this embodiment.

Figure 6:
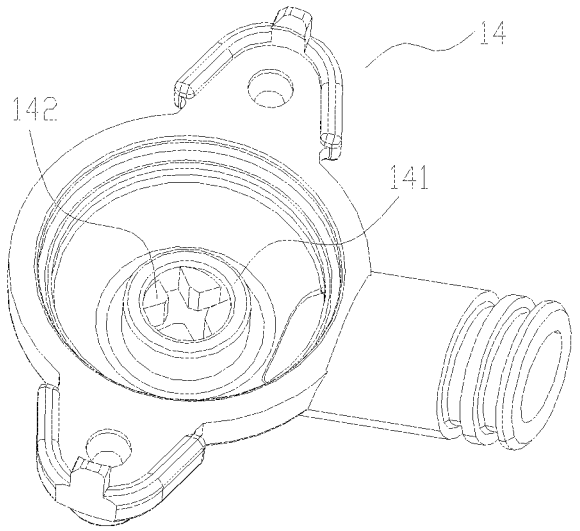
FIG. 6 is a schematic diagram showing a structure of a lower water distributing base.
Figure 7:
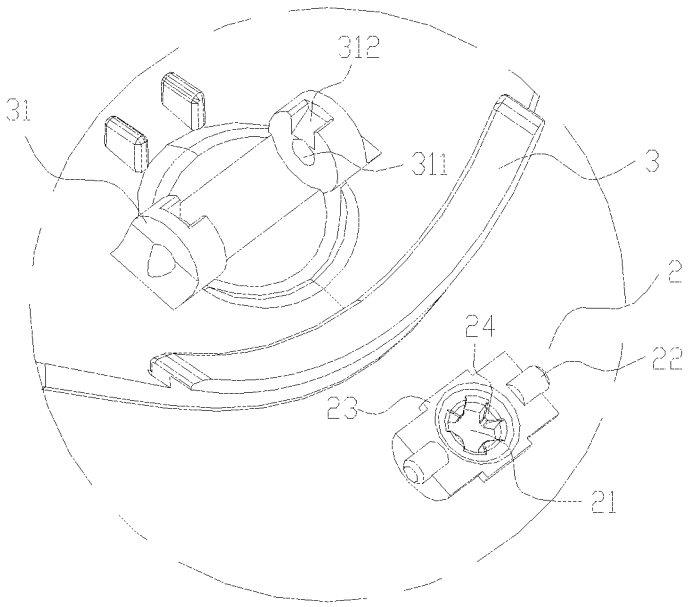
FIG. 7 is a schematic diagram showing a structure of a sound producing member and a button.

As shown in FIG. 6, the lower water distributing base is provided with a second shaft hole 141, second wedge-shaped teeth 142 matched with the lower wedge-shaped teeth are disposed on the second shaft hole; the upper water distributing base is sealed and fixedly connected with the lower water distributing base, and a water distributing chamber is formed between the upper water distributing base and the lower water distributing base, the water distributing tray and the switching shaft are installed in the water distributing chamber; the positioning shaft is inserted into the positioning slot of the switching shaft; the spring is sleeved on the outer wall of the positioning shaft, one end of the spring abuts against the positioning slot, and the other end thereof abuts against the head of the positioning shaft; and the top of the switching shaft extends out from the first shaft hole of the upper water distributing base and can telescopically abut against the sound emitting groove of the sound producing member; and by pressing the switching shaft, the lower wedge-shaped teeth of the switching shaft are matched with the second wedge-shaped teeth of the lower water distributing base, so as to drive the water distributing tray to selectively or partially block the water distributing holes corresponding to the upper water distributing base, so that the water distributing channels with different functions are communicated.

In this embodiment, by matching the lower wedge-shaped teeth of the switching shaft with the second wedge-shaped teeth of the lower water distributing base as well as matching the upper wedge-shaped teeth of the switching shaft with the first wedge-shaped teeth of the upper water distributing base, when the switching shaft is reset by an action of a resilience force of the spring, since each wedge-shaped tooth is provided with an inclined surface, the switching shaft can rapidly and accurately return into the next tooth for the next water function switching.

In order to enable the spring to abut against the water distributing tray, a tenon 124 is disposed on the inner wall of the positioning slot of the water distributing tray, and the spring abuts against the tenon of the water distributing tray.

The upper water distributing base is fixedly connected with the lower water distributing base by a fastener 17, and a first O-shaped sealing ring 18 is disposed on a contact surface between the upper water distributing base and the lower water distributing base. The fastener is a screw or bolt.

A contour sealing ring 19 is disposed between the upper water distributing base and the water distributing tray, and the upper water distributing base is internally provided with an accommodating slotted hole matched with a contour sealing ring, and the contour sealing ring is installed in the accommodating slotted hole.

In this embodiment, a sealing member for maintaining water tightness includes the first O-shaped sealing ring and the contour sealing ring, and sealing between water distributing members and related members is realized by a design of installation positions of the sealing rings.

Embodiment 3. A Shower Head

Figure 8:
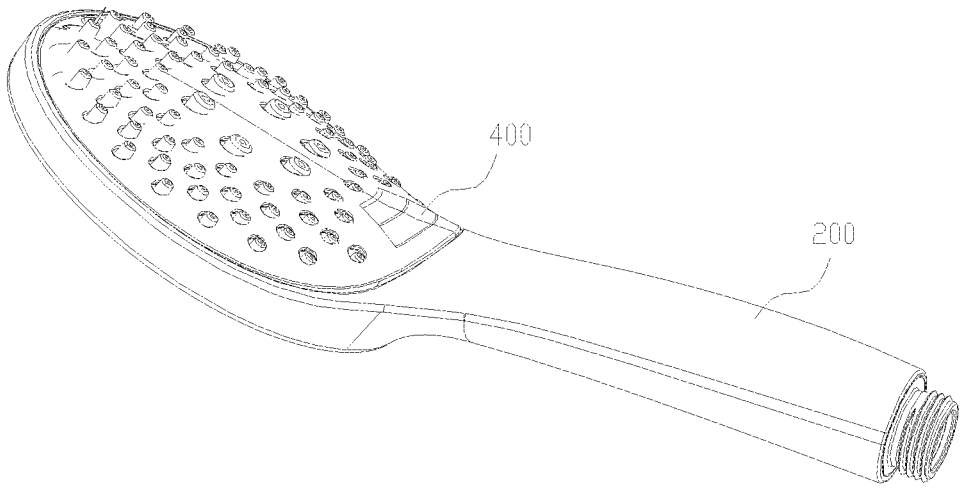
FIG. 8 is a schematic diagram showing a structure of a shower head according to an embodiment of the present disclosure.
Figure 9:
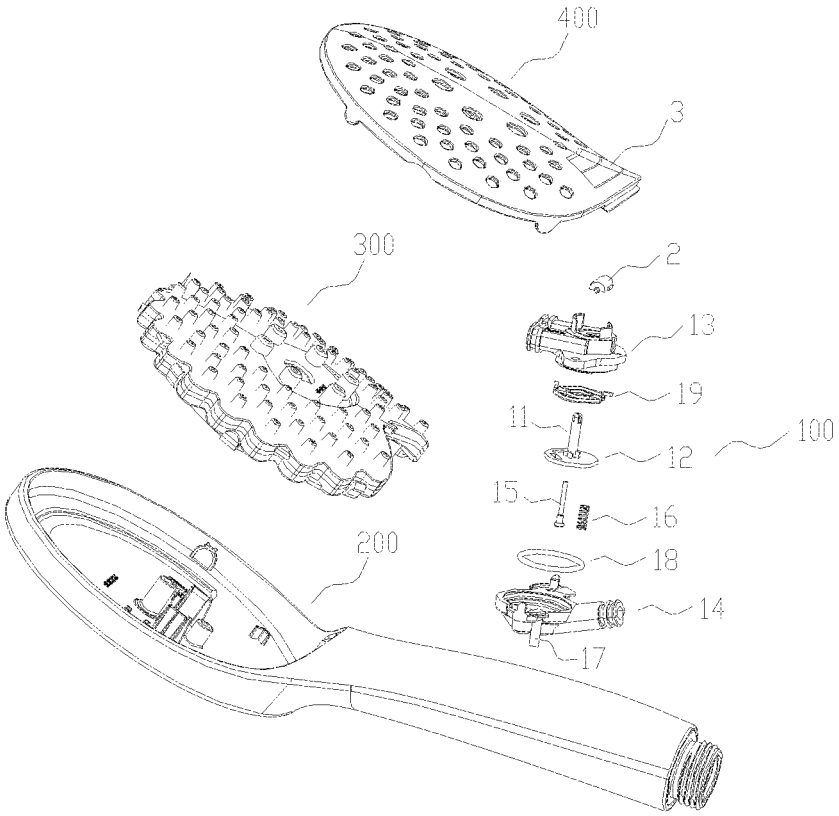
FIG. 9 is a schematic diagram of disassembly of a shower head.
Figure 10:
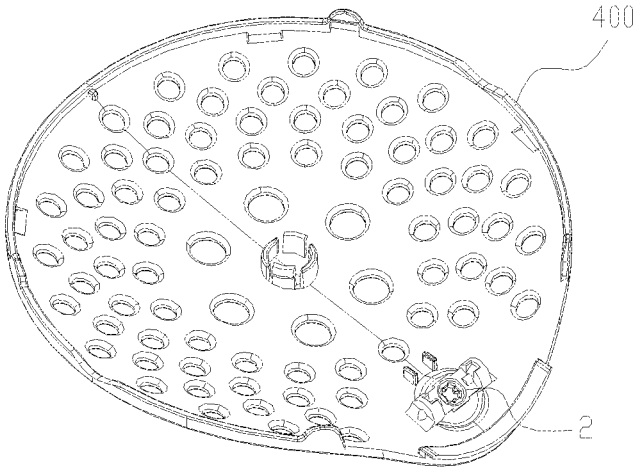
FIG. 10 is a schematic diagram showing a structure of a surface cover and a sound producing member.

As shown in FIG. 8 to FIG. 10, the shower head includes a shower head body 200, a water discharging body 300, a surface cover 400 and a press-switching water discharging mechanism 100 adapted to press at any angle, and at least two functional water channels are disposed on the water discharging body, each functional water channel being in communication with a corresponding water distributing channel; the surface cover is engaged with the shower head body to form an accommodating chamber, and the water distributing body and the press-switching water discharging mechanism are prevented from being in the accommodating chamber; particularly, the press-switching water discharging mechanism includes a press-switching water discharging valve for switching different functional water channels, a button disposed above the press-switching water discharging valve and a sound producing member disposed between the press-switching water discharging valve and the button; the button and the surface cover are integrally connected, and injection-molded at one time; limit bases of the button are disposed at the bottom of the surface cover; the sound producing member is a rotating shaft having a semicircular cross section, and the rotating shaft includes an abutment surface for abutting the press-switching water discharging valve and an arc-shaped surface adapted to press at any angle; pivot shafts for being rotatably installed at the bottom of the button are disposed at two ends of the rotating shaft, and the arc-shaped surface is adapted with a contact surface at the bottom of the button; and a sound emitting groove, adapted with the contact surface of the press-switching water discharging valve, is concave in shape and is disposed on the contact surface of the sound producing member; and the press-switching water discharging valve further includes an upper water distributing base, a lower water distributing base, a positioning shaft and a spring, a positioning slot is disposed in the center of the switching shaft, a water distributing tray is vertically connected to the bottom of the switching shaft, the switching shaft and the water distributing tray are integrally formed; at least two water outlets are opened on the water distributing tray; upper wedge-shaped teeth and lower wedge-shaped teeth are disposed at an upper surface and a lower surface of the water distributing tray; the positioning slot runs through the water distributing tray; the upper water distributing base is provided with a first shaft hole, at least two water distributing holes and at least two water distributing channels corresponding to the water distributing holes; the water distributing holes are communicated with the corresponding water distributing channels; first wedge-shaped teeth matched with the upper wedge-shaped teeth are disposed on the first shaft hole; the lower water distributing base is provided with a second shaft hole, second wedge-shaped teeth matched with the lower wedge-shaped teeth are disposed on the second shaft hole; the upper water distributing base is sealed and fixedly connected with the lower water distributing base, and a water distributing chamber is formed between the upper water distributing base and the lower water distributing base, the water distributing tray and the switching shaft are installed in the water distributing chamber; the positioning shaft is inserted into the positioning slot of the switching shaft; the spring is sleeved on the outer wall of the positioning shaft, one end of the spring abuts against the positioning slot, and the other end thereof abuts against the head of the positioning shaft; and the top of the switching shaft extends out from the first shaft hole of the upper water distributing base and can telescopically abut against the sound emitting groove of the sound producing member; and by pressing the switching shaft, the lower wedge-shaped teeth of the switching shaft are matched with the second wedge-shaped teeth of the lower water distributing base, so as to drive the water distributing tray to selectively or partially block the water distributing holes corresponding to the upper water distributing base, so that the water distributing channels with different functions are communicated.

A water discharging work principle of the press-switching water discharging mechanism is as follows: there are two water distributing channels in this embodiment, respectively, the first water distributing channel and the second water distributing channel; when the shower head is held by hands to switch functions and when the water distributing tray blocks the second water distributing channel, a water flow enters into the first functional water channel of the water distributing body from the water distributing channel, and first functional water is discharged through the water outlets of the surface cover. When the surface cover is pressed, the switching shaft is driven to rotate, such that the water distributing tray rotates, the water distributing tray may not completely block the first water distributing channel and the second water distributing channel, the water flow enters into the two functional water channels of the water distributing body from the two water distributing channels, and mixed functional water is discharged through the water outlets of the surface cover. When the water distributing tray blocks the first water distributing channel, the water flow enters into the second functional water channel of the water distributing body from the second water distributing channel, and second functional water is discharged through the water outlets of the surface cover.

In addition, the press-switching water discharging mechanism of the shower head is reasonable in structure, few in components, compact in structures of the components, and small in occupied space inside the shower head, may enable the shower head to be made thinner, and especially enable the button and the surface cover to be integrally formed, so as to reduce the button as the component, simplify the production procedure and reduce the production cost. Moreover, a design of reducing the button may prevent pollutants from entering the shower head from a gap between the button and the outer wall of the shower head, thereby affecting the health of the person.

The above embodiments are merely preferred embodiments of the present disclosure, and a protective scope of the present disclosure is not limited thereto, and any insubstantial changes and substitutions made by those skilled in the art based on the present disclosure belong to the protective scope claimed by the present disclosure.

What is claimed is:

1. A press-switching water discharging mechanism, comprising a press-switching water discharging valve for switching different functional water channels, a button disposed above the press-switching water discharging valve, and a sound producing member disposed between the press-switching water discharging valve and the button; a switching shaft is disposed on the press-switching water discharging valve, the sound producing member matches with a top of the switching shaft, and limit bases are disposed at the bottom of the button, installation slots are concave in shape and are disposed on the limit bases, and pivot shafts are rotatably installed in the installation slots of the limit bases; the sound producing member comprising a shaft having a semicircular cross section, an abutment surface for abutting a press-switching water discharging valve and an arc-shaped surface; the pivot shafts being rotatably installed in the installation slots of the limit bases at a bottom of a button are disposed at two ends of the shaft, and the arc-shaped surface matches with a contact surface at the bottom of the button; and a sound emitting groove matching with the contact surface of the press-switching water discharging valve is concave in shape and is disposed on the abutment surface of the sound producing member;

wherein the press-switching water discharging valve further comprises an upper water distributing base, a lower water distributing base, a positioning shaft and a spring;

a positioning slot is positioned in the center of the switching shaft, a water distributing tray is vertically connected to the bottom of the switching shaft, and the switching shaft and the water distributing tray are integrally formed; at least two water outlets are opened on the water distributing tray; upper wedge-shaped teeth and lower wedge-shaped teeth are disposed at an upper surface and a lower surface of the water distributing tray; the positioning slot runs through the water distributing tray; the upper water distributing base is provided with a first shaft hole, at least two water distributing holes and at least two water distributing channels corresponding to the water distributing holes; the water distributing holes are communicated with the corresponding water distributing channels; first wedge-shaped teeth matched with the upper wedge-shaped teeth are disposed on the first shaft hole; the lower water distributing base is provided with a second shaft hole, second wedge-shaped teeth matched with the lower wedge-shaped teeth are disposed on the second shaft hole; the upper water distributing base is sealed and fixedly connected with the lower water distributing base, and a water distributing chamber is formed between the upper water distributing base and the lower water distributing base, the water distributing tray and the switching shaft are installed in the water distributing chamber; the positioning shaft is inserted into the positioning slot of the switching shaft the spring is sleeved on the outer wall of the positioning shaft, one end of the spring abuts against the positioning slot, and the other end thereof abuts against the head of the positioning shaft and the top of the switching shaft extends out from the first shaft hole of the upper water distributing base and can telescopically abut against the sound emitting groove of the sound producing member; and by pressing the switching shaft, the lower wedge-shaped teeth of the switching shaft are matched with the second wedge-shaped teeth of the lower water distributing base, so as to drive the water distributing tray to selectively or partially block the water distributing holes corresponding to the upper water distributing base, so that the different functional water distributing channels are communicated.

2. The press-switching water discharging mechanism according to claim 1, wherein guiding inclined surfaces for rapidly installing the pivot shafts are disposed on the limit bases and located above the installation slots.

3. The press-switching water discharging mechanism according to claim 1, a plurality of slots are arranged around a top part of the switching shaft; a plurality of tongues, which are capable of fitting within the slots, are provided around an inner wall of the sound emitting groove, so that the switching shaft and the sound emitting groove are held together.

4. The press-switching water discharging mechanism according to claim 1, wherein a tenon is disposed on the inner wall of the positioning slot of the water distributing tray, and the spring abuts against the tenon of the water distributing tray.

5. The press-switching water discharging mechanism according to claim 1, wherein the upper water distributing base is fixedly connected with the lower water distributing base by a fastener, and a first O-shaped sealing ring is disposed on a contact surface between the upper water distributing base and the lower water distributing base.

6. The press-switching water discharging mechanism according to claim 1, wherein a contour sealing ring is disposed between the upper water distributing base and the water distributing tray, and the upper water distributing base is internally provided with an accommodating slotted hole matched with the contour sealing ring, and the contour sealing ring is installed in the accommodating slotted hole.

7. A shower head, comprising a shower head body, a water discharging body, a surface cover and a press-switching water discharging mechanism, and at least two functional water channels are disposed on the water discharging body, each functional water channel is in communication with a corresponding water distributing channel; the surface cover is engaged with the shower head body to form an accommodating chamber, and the water distributing body and the press-switching water discharging mechanism are prevented from being in the accommodating chamber;

the press-switching water discharging mechanism comprises a press-switching water discharging valve for switching different functional water channels, a button disposed above the press-switching water discharging valve and a sound producing member disposed between the press-switching water discharging valve and the button;

the button and the surface cover are integrally connected, and injection-molded at one time; the limit bases of the button are disposed at the bottom of the surface cover; the sound producing member is a rotating shaft having a semicircular cross section, and the rotating shaft comprises an abutment surface for abutting the press-switching water discharging valve and an arc-shaped surface; pivot shafts being rotatably installed at the bottom of the button are disposed at two ends of the rotating shaft, and the arc-shaped surface is matched with a contact surface at the bottom of the button; and a sound emitting groove matched with the contact surface of the press-switching water discharging valve is concave in shape and is disposed on the contact surface of the sound producing member;

the press-switching water discharging valve comprises a switching shaft, an upper water distributing base, a lower water distributing base, a positioning shaft and a spring, wherein the sound emitting groove matches with the top of the switching shaft; limit bases for installing the pivot shafts are disposed at the bottom of the surface cover, installation slots are concave in shape and are disposed on the limit bases, the pivot shafts are rotatably installed in the installation slots of the limit bases; a positioning slot is disposed in the center of the switching shaft, a water distributing tray is vertically connected to the bottom of the switching shaft, the switching shaft and the water distributing tray are integrally formed; at least two water outlets are opened on the water distributing tray; upper wedge-shaped teeth and lower wedge-shaped teeth are disposed at an upper surface and a lower surface of the water distributing tray; the positioning slot runs through the water distributing tray; the upper water distributing base is provided with a first shaft hole, at least two water distributing holes and at least two water distributing channels corresponding to the water distributing holes; the water distributing holes are communicated with the corresponding water distributing channels; first wedge-shaped teeth matched with the upper wedge-shaped teeth are disposed on the first shaft hole; the lower water distributing base is provided with a second shaft hole, second wedge-shaped teeth matched with the lower wedge-shaped teeth are disposed on the second shaft hole; the upper water distributing base is sealed and fixedly connected with the lower water distributing base, and a water distributing chamber is formed between the upper water distributing base and the lower water distributing base, the water distributing tray and the switching shaft are installed in the water distributing chamber; the positioning shaft is inserted into the positioning slot of the switching shaft; the spring is sleeved on the outer wall of the positioning shaft, one end of the spring abuts against the positioning slot, and the other end thereof abuts against the head of the positioning shaft; and the top of the switching shaft extends out from the first shaft hole of the upper water distributing base and can telescopically abut against the sound emitting groove of the sound producing member; and by pressing the switching shaft, the lower wedge-shaped teeth of the switching shaft are matched with the second wedge-shaped teeth of the lower water distributing base, so as to drive the water distributing tray to selectively or partially block the water distributing holes corresponding to the upper water distributing base, so that the different functional water distributing channels are communicated.

* * * * *